US007462789B2

(12) United States Patent
Yamasaki et al.

(10) Patent No.: US 7,462,789 B2
(45) Date of Patent: Dec. 9, 2008

(54) ROTARY TYPE ENCODER

(75) Inventors: Masato Yamasaki, Okayama (JP); Takumi Nishimoto, Okayama (JP); Jun Sato, Okayama (JP)

(73) Assignee: Panasonic Corporation, Osaka (JP)

( * ) Notice: Subject to any disclaimer, the term of this patent is extended or adjusted under 35 U.S.C. 154(b) by 80 days.

(21) Appl. No.: 11/703,749

(22) Filed: Feb. 8, 2007

(65) Prior Publication Data

US 2007/0193861 A1 Aug. 23, 2007

(30) Foreign Application Priority Data

Feb. 17, 2006 (JP) ..... 2006-040558

(51) Int. Cl.
*H01H 19/58* (2006.01)

(52) U.S. Cl. ..... 200/11 DA; 200/11 R

(58) Field of Classification Search ..... 200/11 DA, 200/11 R, 11 G, 571, 19.07
See application file for complete search history.

(56) References Cited

U.S. PATENT DOCUMENTS 3,609,258 A * 9/1971 Leland ..... 200/11 D
3,949,638 A * 4/1976 Coles ..... 84/685
4,038,504 A * 7/1977 McAnulty et al. ..... 200/11 DA
4,163,879 A * 8/1979 Mayer et al. ..... 200/11 TW
4,218,593 A * 8/1980 Mayer et al. ..... 200/11 TW
4,578,547 A * 3/1986 Gunther et al. ..... 200/11 DA
4,640,995 A * 2/1987 Naaijer ..... 200/11 DA
5,886,310 A * 3/1999 Kataoka et al. ..... 200/14
5,959,269 A * 9/1999 Bauer et al. ..... 200/11 R
6,248,964 B1 * 6/2001 Bailey et al. ..... 200/11 DA
6,333,473 B1 * 12/2001 Sawada et al. ..... 200/4
6,388,211 B1 * 5/2002 Nomura et al. ..... 200/11 DA
6,396,006 B1 * 5/2002 Yokoji et al. ..... 200/4
6,784,383 B2 * 8/2004 Sugahara et al. ..... 200/11 R
6,855,896 B2 * 2/2005 Oikawa ..... 200/61.54
6,856,261 B2 * 2/2005 Yoritsune et al. ..... 341/16
7,030,326 B2 * 4/2006 Wilsser ..... 200/16 A

FOREIGN PATENT DOCUMENTS

JP 1-152314 6/1989
JP 2005-172552 6/2005

* cited by examiner

*Primary Examiner*—Michael A Friedhofer
*Assistant Examiner*—Lisa N Klaus
(74) *Attorney, Agent, or Firm*—Wenderoth, Lind & Ponack L.L.P

(57) ABSTRACT

In a rotary encoder, a range of operable angle is divided into four large sections. A plurality of signal contact shoes come into contact with signal conductive portions in different combinations at individual positions within each of the large sections, and these states of contacting combinations repeat in each of the large sections. A plurality of common contact shoes correspond individually to four large sections, and each remains in contact with a common conductive portion continuously in the corresponding large section.

3 Claims, 10 Drawing Sheets

FIG. 3 →

| | Position | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|---|
| | First large section | | | | | | | | Second large section | | | | | | | | Third large section | | | | | | | | Fourth large section | | | | | | | |
| | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | 32 |
| COM1 | ○ | ○ | ○ | ○ | ○ | ○ | ○ | ○ | | | | | | | | | | | | | | | | | | | | | | | | |
| COM2 | | | | | | | | | ○ | ○ | ○ | ○ | ○ | ○ | ○ | ○ | | | | | | | | | | | | | | | | |
| COM3 | | | | | | | | | | | | | | | | | ○ | ○ | ○ | ○ | ○ | ○ | ○ | ○ | | | | | | | | |
| COM4 | | | | | | | | | | | | | | | | | | | | | | | | | ○ | ○ | ○ | ○ | ○ | ○ | ○ | ○ |
| | | | | | | | | | | | | | | | | | | | | | | | | | | | | | | | | |
| | | | | | | | | | | | | | | | | | | | | | | | | | | | | | | | | |
| SIG1 | ○ | ○ | ○ | ○ | | | | | ○ | ○ | ○ | ○ | | | | | ○ | ○ | ○ | ○ | | | | | ○ | ○ | ○ | ○ | | | | |
| SIG2 | | ○ | ○ | ○ | ○ | | | | | ○ | ○ | ○ | ○ | | | | | ○ | ○ | ○ | ○ | | | | | ○ | ○ | ○ | ○ | | | |
| SIG3 | | | ○ | ○ | ○ | ○ | | | | | ○ | ○ | ○ | ○ | | | | | ○ | ○ | ○ | ○ | | | | | ○ | ○ | ○ | ○ | | |
| SIG4 | | | | ○ | ○ | ○ | ○ | | | | | ○ | ○ | ○ | ○ | | | | | ○ | ○ | ○ | ○ | | | | | ○ | ○ | ○ | ○ | |
| SIG5 | | | | | ○ | ○ | ○ | ○ | | | | | ○ | ○ | ○ | ○ | | | | | ○ | ○ | ○ | ○ | | | | | ○ | ○ | ○ | ○ |

FIG. 8 – PRIOR ART
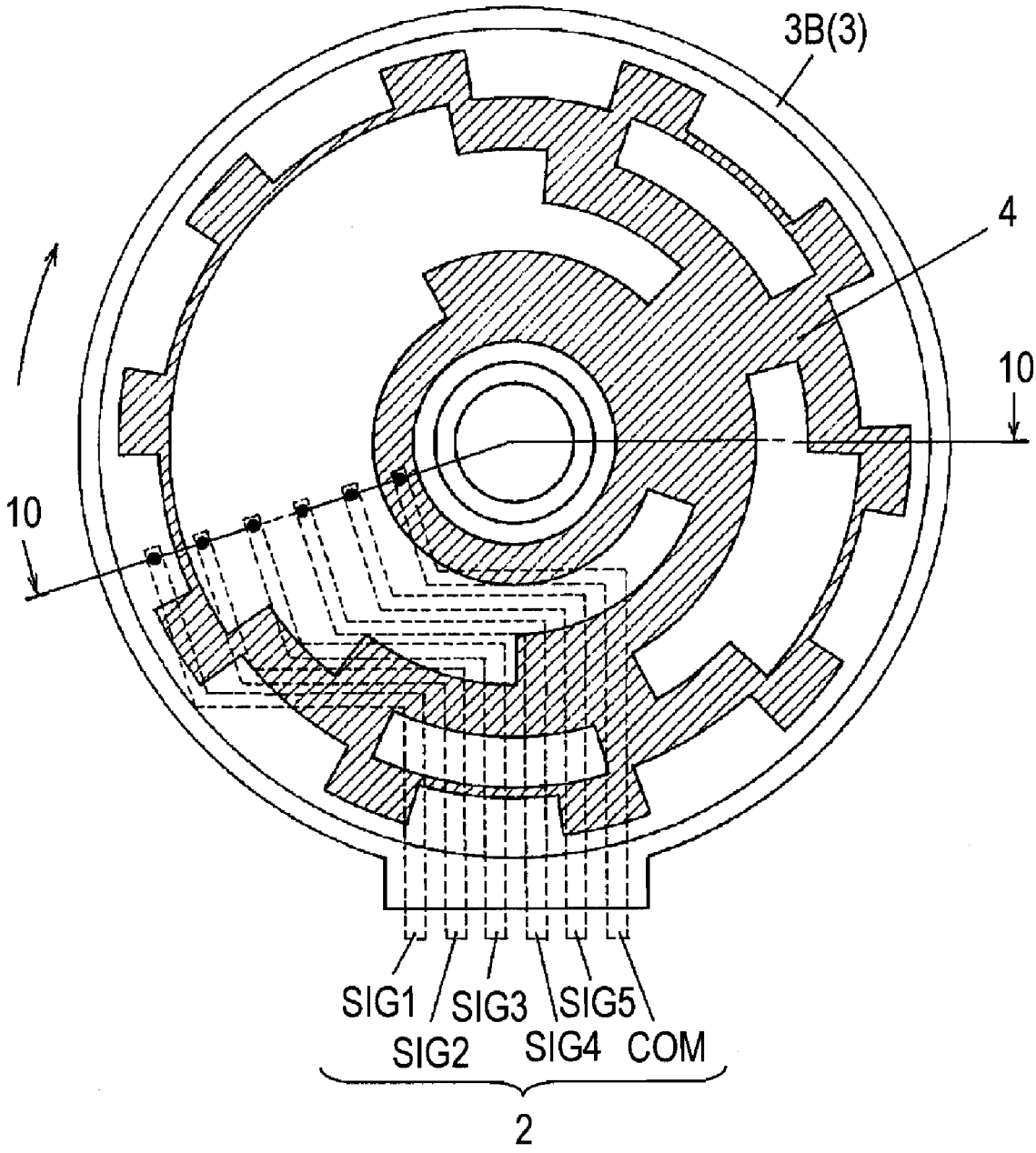

FIG. 9 – PRIOR ART

Position

| | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | 32 |
|---|---|---|---|---|---|---|---|---|---|---|---|---|---|---|---|---|---|---|---|---|---|---|---|---|---|---|---|---|---|---|---|---|
| COM | O | O | O | O | O | O | O | O | O | O | O | O | O | O | O | O | O | O | O | O | O | O | O | O | O | O | O | O | O | O | O | O |
| SIG1 | | O | O | | | O | O | | | O | O | | | O | O | | | O | O | | | O | O | | | O | O | | | O | O | |
| SIG2 | | | O | O | O | O | | | | | O | O | O | O | | | | | O | O | O | O | | | | | O | O | O | O | | |
| SIG3 | | | | | O | O | O | O | O | | O | O | | | | | | | | | O | O | O | O | O | O | O | O | | | O | |
| SIG4 | | | | | | | | | O | O | O | O | O | O | O | O | O | O | | O | O | O | O | O | | | | | | | | |
| SIG5 | | | | | | | | | | | | | | | | | O | O | O | O | O | O | O | O | O | O | O | O | | O | O | O |

FIG. 10 – PRIOR ART
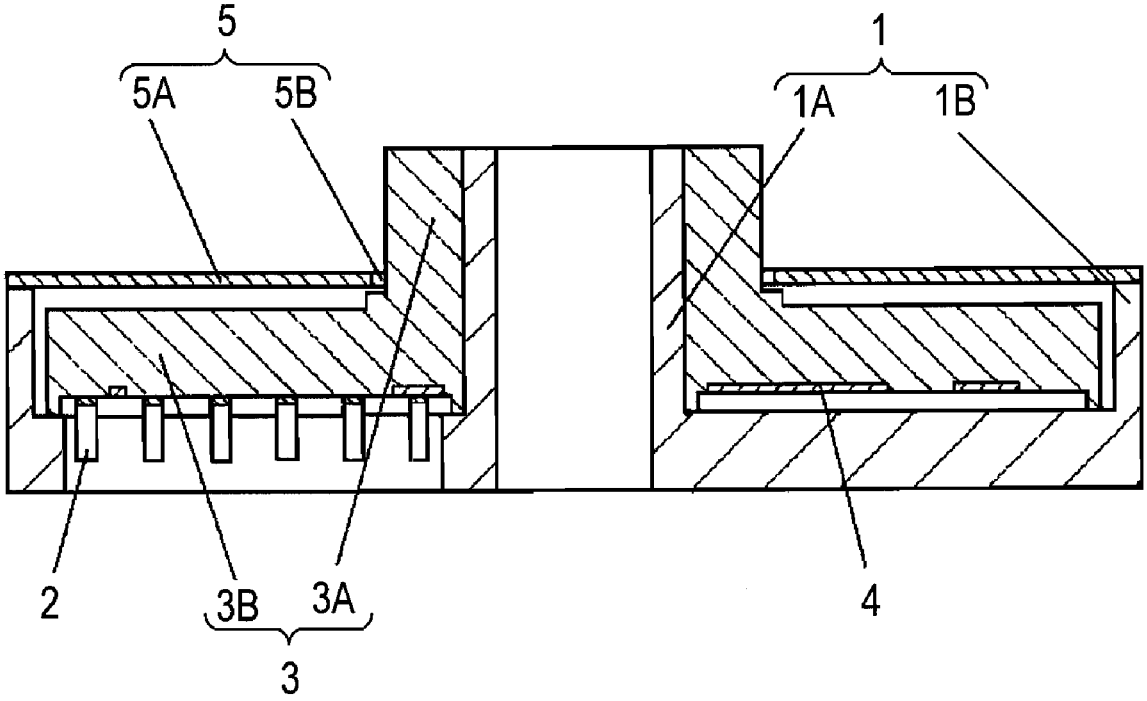

ROTARY TYPE ENCODER

FIELD OF THE INVENTION

The present invention relates to a rotary type encoder used for an input control unit of a variety of electronic apparatuses.

BACKGROUND OF THE INVENTION

There is a continuous growth in recent years in number of electronic apparatuses equipped with rotary type encoders for their input control units, particularly for such applications as input controllers for temperature adjustment of air conditioners mounted on automobiles.

Referring to FIG. 8 to FIG. 10, description is provided hereinafter of a conventional rotary type encoder.

FIG. 8 is a plan view showing contact positions of contact shoes and a rotary contact plate of the conventional rotary type encoder, FIG. 9 is a table showing a relation of contact positions between the contact shoes and the rotary contact plate at various positions, and FIG. 10 is a cross sectional view of the encoder taken along the line 10-10 of FIG. 8.

As shown in FIG. 10, lower case 1 made of a molded resin has an exterior with a generally annular shape, and both inner cylindrical portion 1A configuring a center hole and outer wall portion 1B protrude upward, leaving an open-top hollow portion between them. There are six electrically independent contact shoes 2 arranged in line along the radial direction on a bottom surface of the hollow portion with their points extending upward as being free ends.

Rotary body 3 is provided with flange portion 3B of an annular shape at the lower side of cylindrical portion 3A with a center hole in the center thereof. Cylindrical portion 3A of rotary body 3 is fitted in a rotatable manner on the outer surface of inner cylindrical portion 1A of lower case 1.

Flange portion 3B is provided with rotary contact plate 4 (refer to FIG. 8) on the underside thereof to generate 5 bits of absolute output. When rotary body 3 is assembled with lower case 1, six contact shoes 2 come into thrusting contact with the underside of flange portion 3B where rotary contact plate 4 is provided.

The top of the hollow portion of lower case 1 is covered with flat portion 5A of metal cover 5, which is attached to lower case 1. Metal cover 5 has center opening 5B in its flat portion 5A. Inner cylindrical portion 1A of lower case 1 and cylindrical portion 3A of rotary body 3 project upward from center opening 5B in a concentric manner, and cylindrical portion 3A serves as a control portion. A rotatable angle of operation of rotary body 3 is restricted by metal cover 5, although not shown in the figures.

Rotary contact plate 4 has a configuration, which is described now by referring to FIG. 8. Rotary contact plate 4 comprises a common conductive portion of an annular shape exposed in the innermost area, and a signal conductive portions exposed in a peripheral area surrounding the common conductive portion. These exposed conductive portions are hatched in FIG. 8 to make them easily discernible. In addition, black dots are added to indicate points where contact shoes 2 are in contact with either the underside of flange portion 3B or rotary contact plate 4 on rotary body 3.

These conductive portions are electrically continuous throughout, and they are so configured that they produce 32 variations of detectable output modes, as shown in FIG. 9, when six contact shoes 2 come into contact therewith at each of thirty-two (32) angular positions within a range of the rotatable angle, which is divided into thirty-one (31) parts at equal angular intervals. Circular marks in FIG. 9 indicate positions where contact shoes 2 come into contact with, and therefore have electrical continuity with rotary contact plate 4.

FIG. 8 shows one of the positions in the range of the rotatable angle, and that rotary body 3 is rotatable from this position to an angle of 279° as shown by an arrow indicating the clockwise direction in this figure.

In the conventional rotary type encoder constructed as described above, cylindrical portion 3A is turned to rotate rotary body 3 and move positions where six contact shoes 2 (i.e., COM and SIG1 to SIG5) come into contact with rotary contact plate 4 on the underside thereof, thereby making it capable of detecting an output mode corresponding to the angular position.

Detection of the output mode is achieved by checking presence or absence of continuity of each of five contact shoes 2 (SIG1 to SIG5) with respect to common contact shoe 2 (COM) provided at the innermost position through the signal conductive portions conductively linked with the common conductive portion.

There are a number of prior art documents known to be related to the invention of this application, including Japanese Patent Unexamined Publications, Nos. 1989-152314 and 2005-172552, for example.

There is a problem, however, with the conventional rotary type encoder described above in that it has a large external size due its structure having the six contact shoes 2 mounted along the radial direction.

SUMMARY OF THE INVENTION

The present invention relates to a rotary type encoder having an operable angle smaller than 360°, and adaptable for detecting an operating angle at each of n positions of equal angular intervals within a range of the operable angle. The rotary type encoder comprises a plurality of signal contact shoes and a plurality of common contact shoes disposed in an electrically independent manner along two concentrical tracks, the range of the operable angle divided into m parts of large sections having an equal angle, the plurality of signal contact shoes coming into thrusting contact with signal conductive portions in different states at each of the positions within the large section, and the states of thrusting contact are repeated in each of the large sections. There are m pieces of common contact shoes provided for the purpose of distinguishing the states of thrusting contact between the signal contact shoes and the signal conductive portions as occurring in each of the large sections, each of the common contact shoes coming into contact at least with a common conductive portion within a respective one of the large sections, and the signal conductive portions and the common conductive portion being electrically continuous, wherein the position of the operating angle is determined by detecting continuity between each of the signal contact shoes and each of the common contact shoes.

The present invention provides the rotary type encoder of a small external size having a two-track structure, and adaptable for detecting an operating angle at n positions of equal angular intervals.

BRIEF DESCRIPTION OF THE DRAWINGS

FIG. 3 is a table showing a relation of contacts between the contact shoes and the rotary contact plate at various positions of the rotary type encoder;

FIG. 8 is a plan view showing contact positions between contact shoes and a rotary contact plate of a conventional rotary type encoder;

FIG. 9 is a table showing a relation of contacts between the contact shoes and the rotary contact plate at various positions of the conventional encoder; and FIG. 10 is a cross sectional view of the conventional encoder taken along the line 10-10 of FIG. 8.

DETAILED DESCRIPTION OF PREFERRED EMBODIMENT

Description is provided hereinafter of an exemplary embodiment of the present invention with reference to FIG. 1 to FIG. 7.

Exemplary Embodiment

Figure 1:
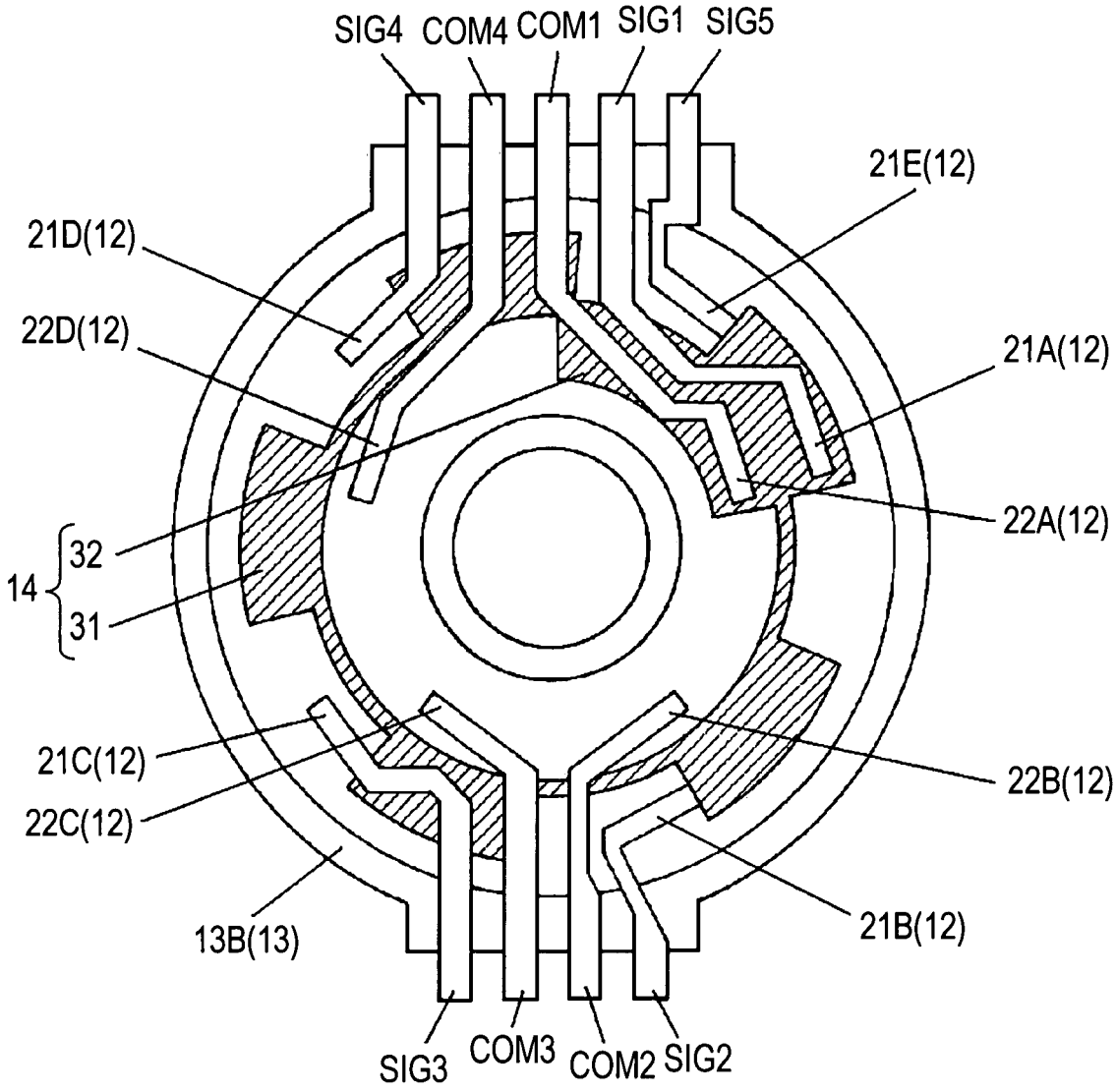
FIG. 1 is a plan view showing a positional relation between contact shoes and a rotary contact plate of a rotary type encoder of the present invention.
Figure 2:
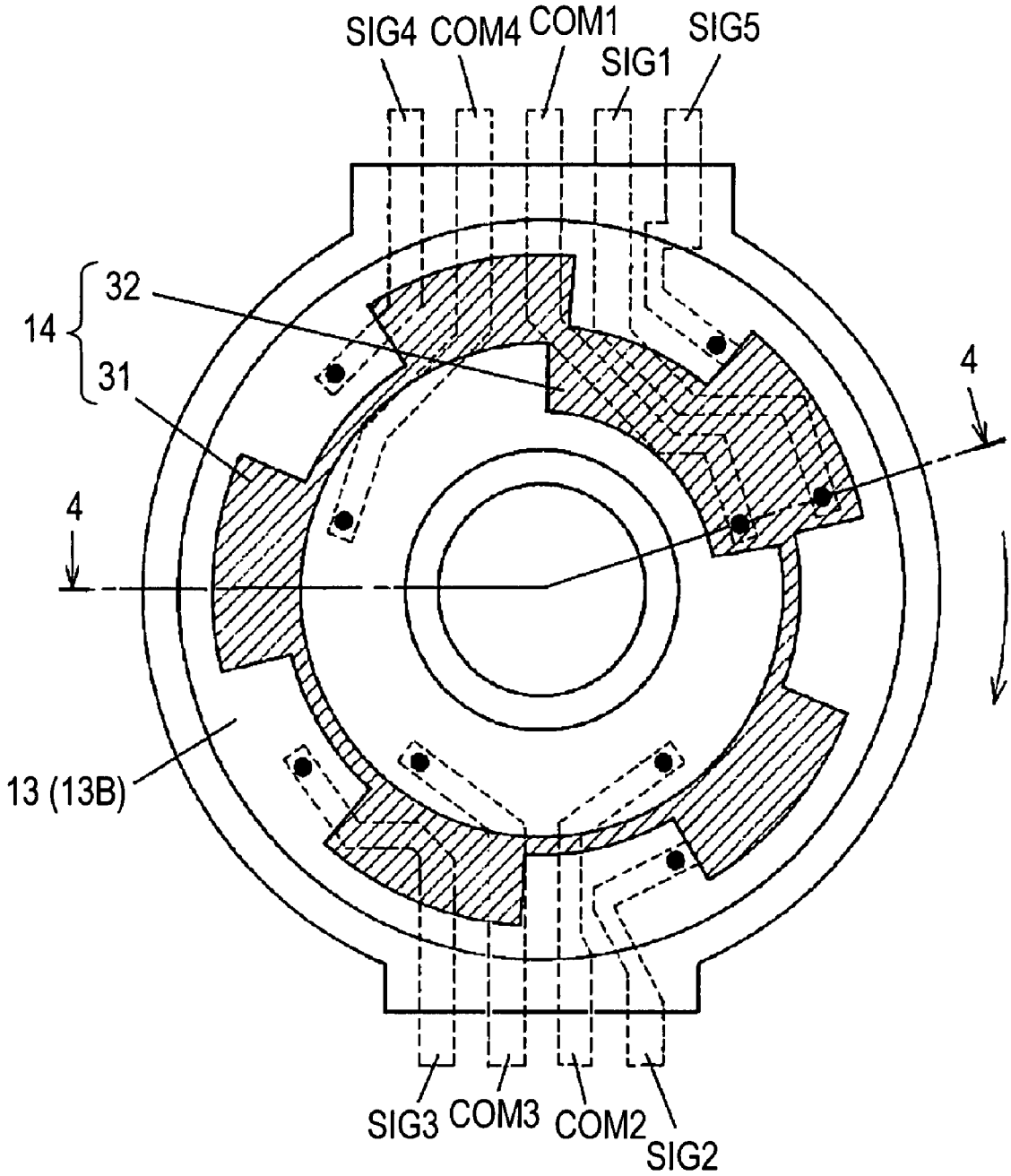
FIG. 2 is a plan view showing contact positions between the contact shoes and the rotary contact plate of the rotary type encoder.
Figure 4:
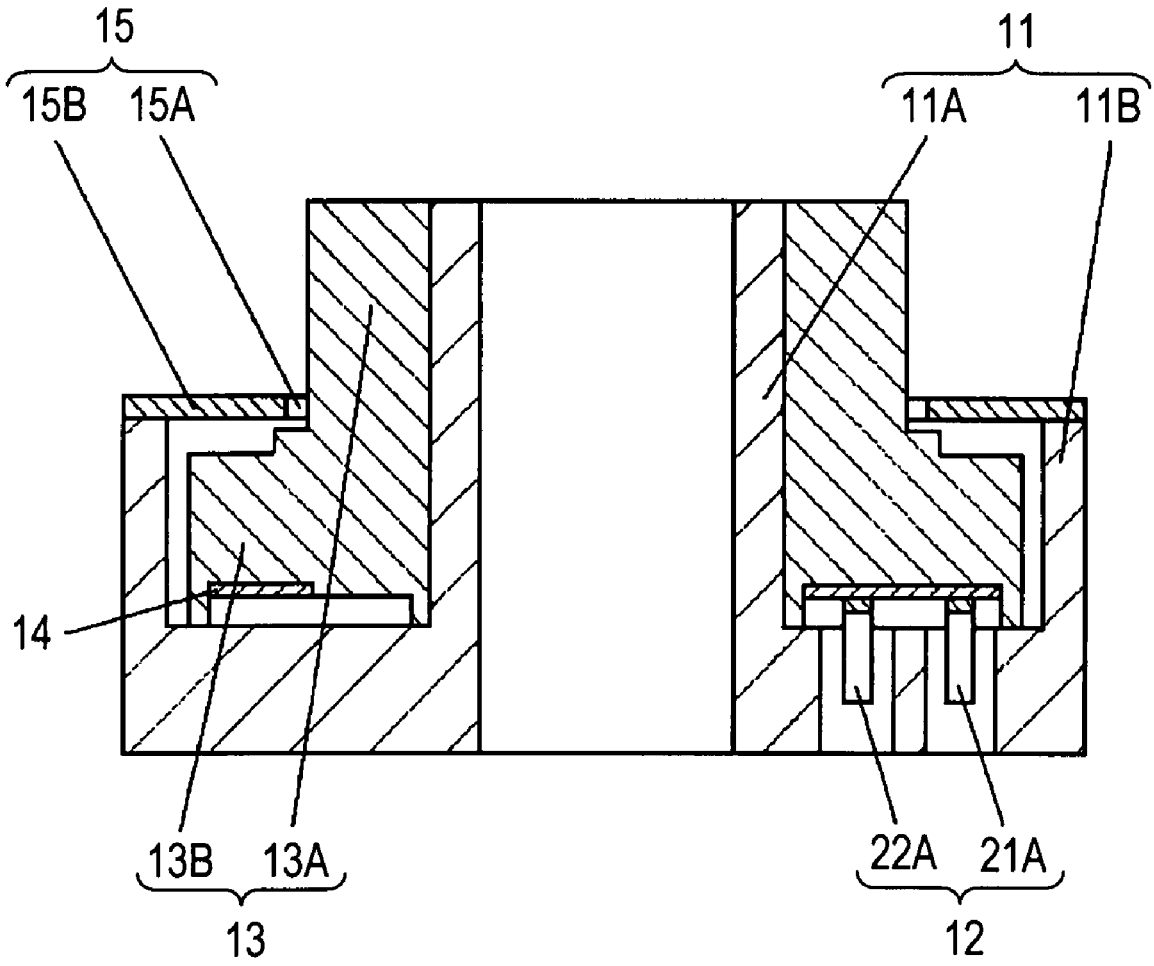
FIG. 4 is a cross sectional view of the encoder taken along the line 4-4 of FIG. 2.

FIG. 1 is a plan view showing a positional relation between contact shoes and a rotary contact plate of a rotary type encoder of the present invention, FIG. 2 is a plan view showing contact positions between the contact shoes and the rotary contact plate, FIG. 3 is a table showing a relation of contacts between the contact shoes and the rotary contact plate at various positions, and FIG. 4 is a cross sectional view of the encoder taken along the line 4-4 of FIG. 2.

In FIG. 4, lower case 11 made of a molded resin has an exterior with a generally annular shape, and rotary body 13 having cylindrical portion 13A is fitted on an outer surface of inner cylindrical portion 11A of lower case 11 in a rotatable manner. Flange portion 13B of an annular shape provided at the lower side of rotary body 13 is placed in an open-top hollow portion formed between inner cylindrical portion 11A and outer wall portion 11B of lower case 11.

An upper area of the hollow portion of lower case 11 is covered with flat portion 15B of metal cover 15 attached to lower case 11, and inner cylindrical portion 11A of lower case 11 and cylindrical portion 13A of rotary body 13 project upward in a concentric manner from center opening 15A of this flat portion 15B. A rotatable angle of rotary body 13 is restricted by metal cover 15, although not shown in the figures.

There are contact shoes 12 arranged along two concentrical tracks on a bottom surface of the hollow portion of lower case 11 in a manner so that there are only two of them across a radial direction. The points of contact shoes 12 extending upward from the bottom surface are in thrusting contact with rotary contact plate 14 on the underside of flange portion 13B.

In the rotary type encoder of the above structure, cylindrical portion 13A of rotary body 13 is turned to rotate rotary contact plate 14 relative to contact shoes 12 for detecting an angular position among n positions of equal angular intervals within a range of operable angle T set smaller than 360°.

Description is provided here of an arrangement of contact shoes 12 and rotary contact plate 14 by using the structure shown in FIG. 1, FIG. 2 and FIG. 3 as an example, which provides a capability of detecting 5 bits of output modes (i.e., 32 in number of the output combinations) within the range of operable angle T as being 279°.

FIG. 2 shows a state of contacts at a first position in the table of FIG. 3. Rotary body 13 is rotatable from the first position to the thirty-second position in the table of FIG. 3 for an angle of 279° when turned in the direction of an arrow shown in FIG. 2. Contact shoes 12 comprise a plurality of signal contact shoes 21A to 21E and another plurality of common contact shoes 22A to 22D (FIG. 4 shows only contact shoes 21A and 22A).

The plurality of signal contact shoes 21A to 21E are disposed individually at predetermined positions in a circular configuration. The plurality of common contact shoes 22A to 22D are disposed individually at predetermined positions in another circular configuration inside of and concentrical with the circular configuration of signal contact shoes 21A to 21E.

A number of the signal contact shoes disposed here is determined according to number m of divided areas included in the range of operable angle T. These areas are hereafter called large sections (T/m), and the number is set to be m=4.

In other words, the number of signal contact shoes is obtained according to the equation of $n/(2\times m)+1=32/(2\times 4)+1$, which comes to five (5) for positions 21A to 21E.

Rotary contact plate 14 has signal conductive portions 31 corresponding to signal contact shoes 21A to 21E. These signal conductive portions 31 are formed into a tooth-like shape, in which they are arranged in positions of a circular configuration corresponding to that of signal contact shoes 21A to 21E in an alternate manner with a non-conductive portion, or an insulation surface, on underside of flange portion 13B.

An angular area occupied by each of signal conductive portions 31 is set to 27° obtained from the formula of $(n/(2\times m)-1)\times$(angle of one interval). In order to obtain thirty-two (32) variations of output modes within the 279° range of operable angle T, a total number of dividing intervals among these positions comes to thirty-one (31). This leads to the formula of $T/(n-1)$ to represent the above angle of one interval, which becomes $279/(32-1)=9°$. On the other hand, the non-conductive portion is set to be 45° as obtained from the formula of $(n/(2\times m)+1)\times$(angle of one interval).

Signal conductive portions 31 and common conductive portion 32 (to be described later) are hatched in FIG. 1 and FIG. 2 to make them easily discernible.

Each of five signal contact shoes 21A to 21E is disposed at a position shifted by the angle of one interval (i.e., $T/(n-1)$) with respect to signal conductive portions 31 along the same circular configuration. Signal conductive portions 31 designed in this manner has a simple tooth-like shape, and five signal contact shoes 21A to 21E can also be arranged easily.

Signal contact shoes 21A to 21E and signal conductive portions 31 arranged in this manner repeat the same states of thrusting contact in each of the large sections.

In the first large section of the table in FIG. 3, only one signal contact shoe 21A corresponding to terminal SIG1 is in thrusting contact with signal conductive portion 31 in a first position.

In a second position, another signal contact shoe 21B corresponding to terminal SIG2 comes into thrusting contact with signal conductive portion 31 in addition to signal contact shoe 21A.

In a third position, another signal contact shoe 21C corresponding to terminal SIG3 comes into thrusting contact with signal conductive portion 31 in addition to signal contact shoes 21A and 21B.

In a fourth position, another signal contact shoe 21D corresponding to terminal SIG4 comes into thrusting contact with signal conductive portion 31 in addition to signal contact shoes 21A, 21B and 21C.

In a fifth position, another signal contact shoe 21E corresponding to terminal SIG5 comes into thrusting contact with signal conductive portion 31 in addition to signal contact shoes 21B, 21C and 21D, while signal contact shoe 21A comes out of contact.

In a sixth position, only signal contact shoes 21C, 21D and 21E remain in thrusting contact with signal conductive portions 31 since signal contact shoe 21B comes out of contact.

In a seventh position, only signal contact shoes 21D and 21E remain in thrusting contact with signal conductive portions 31 since signal contact shoe 21C comes out of contact.

In an eighth position, only signal contact shoe 21E remains in thrusting contact with signal conductive portion 31 since signal contact shoe 21D also comes out of contact.

The above set of eight modes from the first position to the eighth position is repeated m times in the range of operable angle T.

There are m pieces of common contact shoes 22A to 22D disposed in another circular configuration inside of signal contact shoes 21A to 21E, and common conductive portion 32 formed inside of signal conductive portions 31. Common contact shoes 22A to 22D are provided to distinguish the m sets of modes in the individual large sections. Common conductive portion 32 is also formed in an angle covering the above set of eight positions.

Each of common contact shoes 22A to 22D corresponds to each set of the above modes, and remains in the thrusting contact with common conductive portion 32 continuously through the angle covering the corresponding set. In other words, common contact shoe 22A corresponding to terminal COM1 remains in the thrusting contact with common conductive portion 32 continuously throughout the first position to the eighth position shown in FIG. 1 and FIG. 2.

As described above, the rotary type encoder of this exemplary embodiment has a structure comprising the signal-group contacts and the common-group contacts in two tracks.

A position of the operating angle is determined by checking continuities among nine terminals in the total number of signal contact shoes 21A to 21E and common contact shoes 22A to 22D In the first position of the first large section, for instance, continuity can be detected only between terminals COM1 and SIG1 since there are only common contact shoe 22A and signal contact shoe 21A in thrust contact with their respective common conductive portion 32 and signal conductive portion 31, and all other contact shoes remain isolated electrically. It is thus determined that the rotary body is in the first position, and hence the position of operating angle is known.

It is necessary to check twenty (20) combinations of continuities per each position at all the time to confirm all states of the continuities among the total of 9 terminals COM1 to COM4 and SIG1 to SIG5. However, the above confirmation is a easy task when carried out with any of the latest microcomputers, of which improvement of processing speeds and the like is remarkable.

In the second position, continuity can be detected only between terminals COM1 and SIG1 and between terminals COM1 and SIG2, thereby making it possible to determine that it is in the second position. The third position to the eighth position can also be determined in the like manner.

In the second large section, common contact shoe 22B comes into contact with common conductive portion 32 while common contact shoe 22A separates from common conductive portion 32. In the ninth position, for example, continuity can be detected only between terminals COM2 and SIG1. Since this result is different from that of the first large section, it can be determined as to be the ninth position.

Each of common contact shoes 22A to 22D is allocated individually to a corresponding one of the large sections in the above manner to make it in thrusting contact with common conductive portion 32, so as to enable identification of the position of operating angle even though the signal-group contacts repeat the same modes of outputs.

As described above, the rotary type encoder of this exemplary embodiment can contribute greatly to downsizing of the external size since it is adaptable for detecting 5 bits of output modes in spite of the two-track structure.

Although the rotary type encoder of above structure has thirty-two detectable positions, it may be used for a smaller number of positions by reducing the operable angle of rotation.

The above embodiment of the 5-bit mode makes the structure simple. However, application of this invention shall not be considered as to be limited to the structure described above.

In addition, the ideas of this invention can be embodied in many ways such as structures of 4-bit mode and 6-bit mode other than the 5-bit mode.

In order to make the plurality of angular positions uniquely identifiable, it is indispensable to avoid repeating of any combination of continuity modes among four common contact shoes 22A to 22D corresponding to terminals COM1 to COM4 and five signal contact shoes 21A to 21E corresponding to terminals SIG1 to SIG5 with respect to positions on the conductive portions of rotary contact plate 14 at one angular position. It is important for this reason to configure the structure so as not to cause overlapping of the states of continuities of the signal group contacts at any boundary of shifting the output modes from one large section to another.

Description is provided further of the basic ideas behind design of the boundaries of shifting the output modes between the large sections.

As described, the rotary type encoder of this exemplary embodiment comprises the large sections, wherein the five signal contact shoes come into contact with the signal conductive portions in eight different modes while only one common contact shoe stays in contact with the common conductive portion, and the eight modes are allocated as eight positions for each of the large sections. Description is provided hereinafter of a boundary of shifting from the first large section to the second large section, as an example, with reference to FIG. 5 to FIG. 7.

Figure 5:
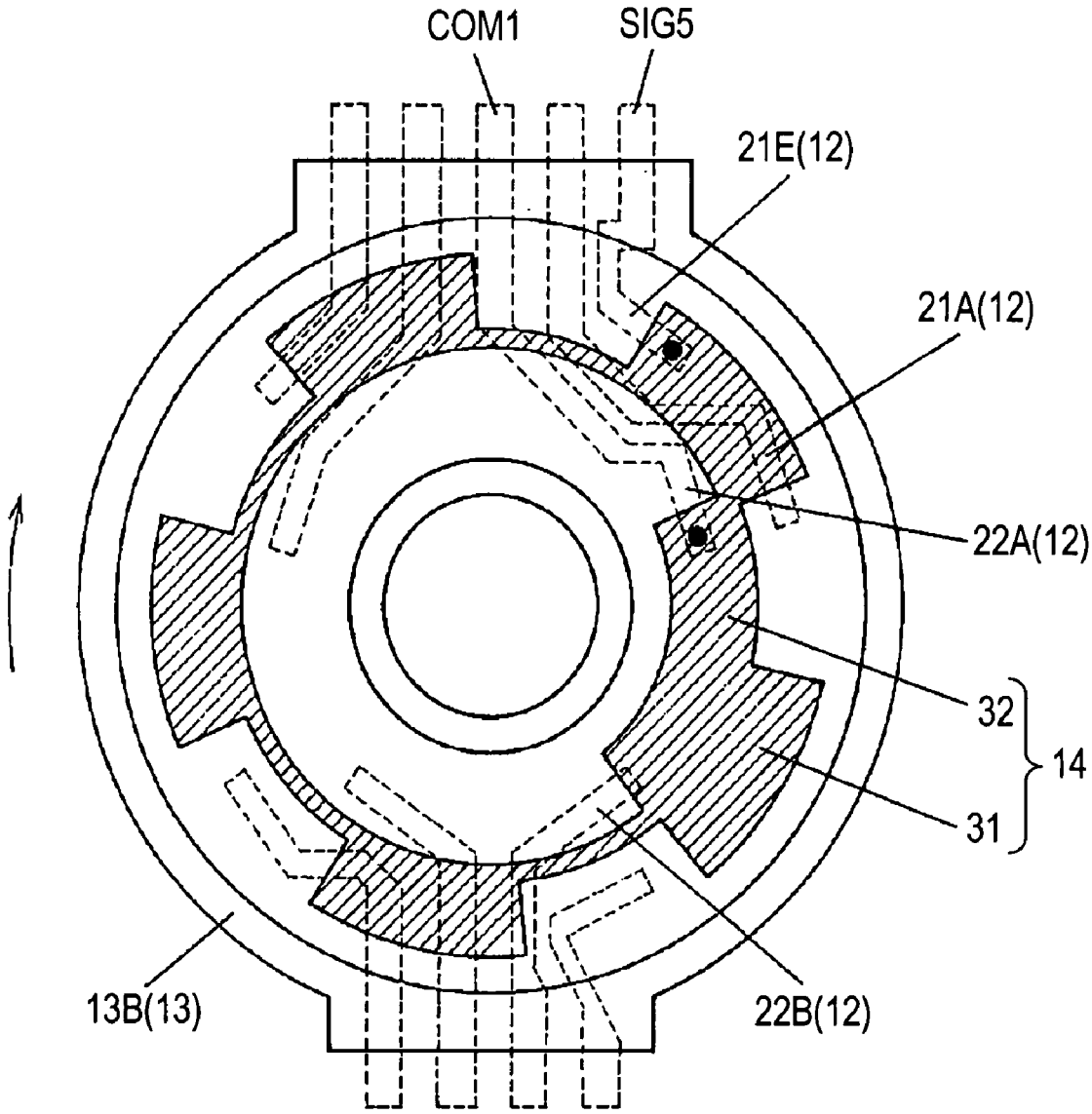
FIG. 5 is a plan view showing contact positions between the contact shoes and the rotary contact plate at an eighth position in the table of FIG. 3.
Figure 6:
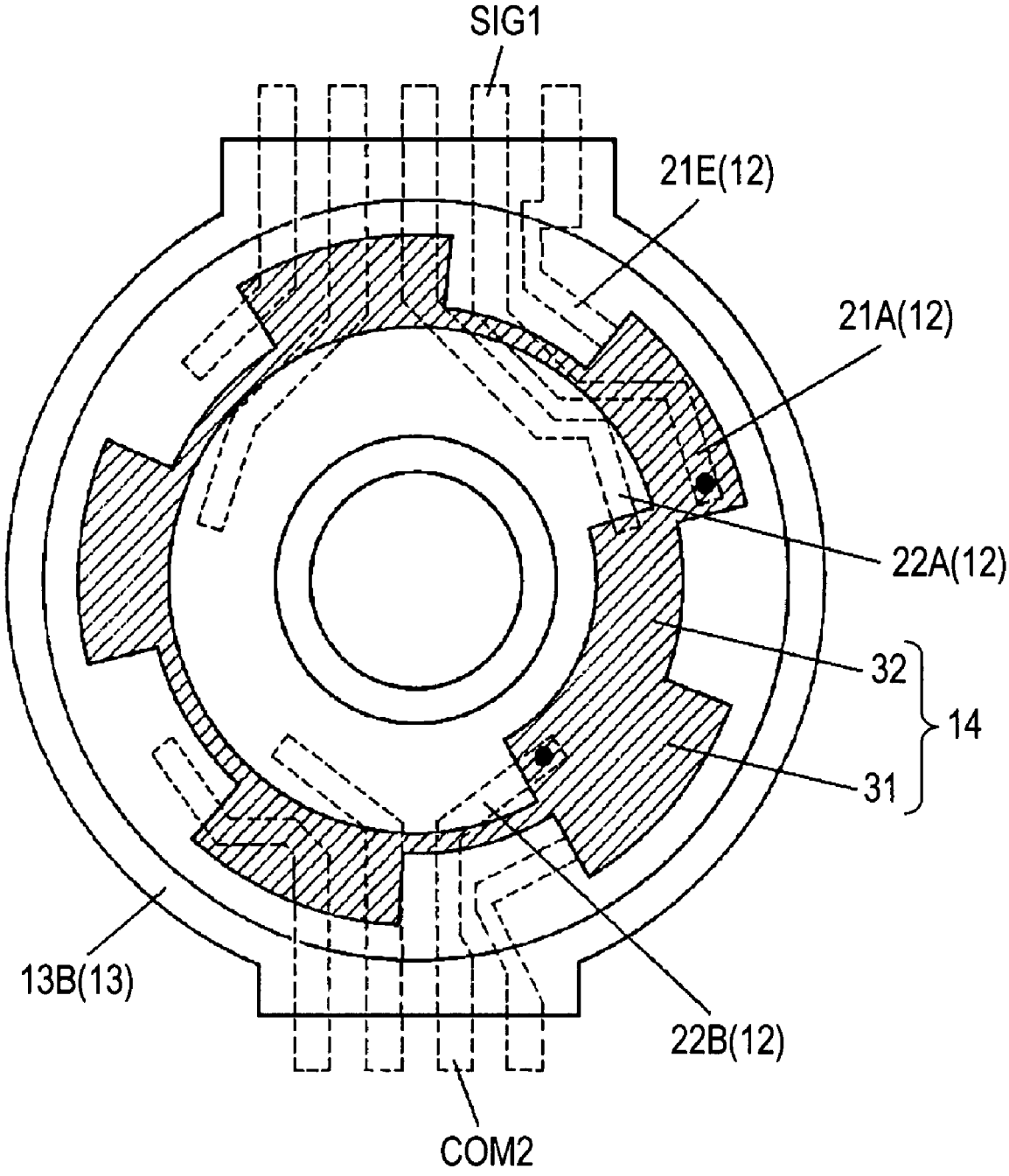
FIG. 6 is a plan view showing contact positions between the contact shoes and the rotary contact plate at a ninth position in the table of FIG. 3.
Figure 7:
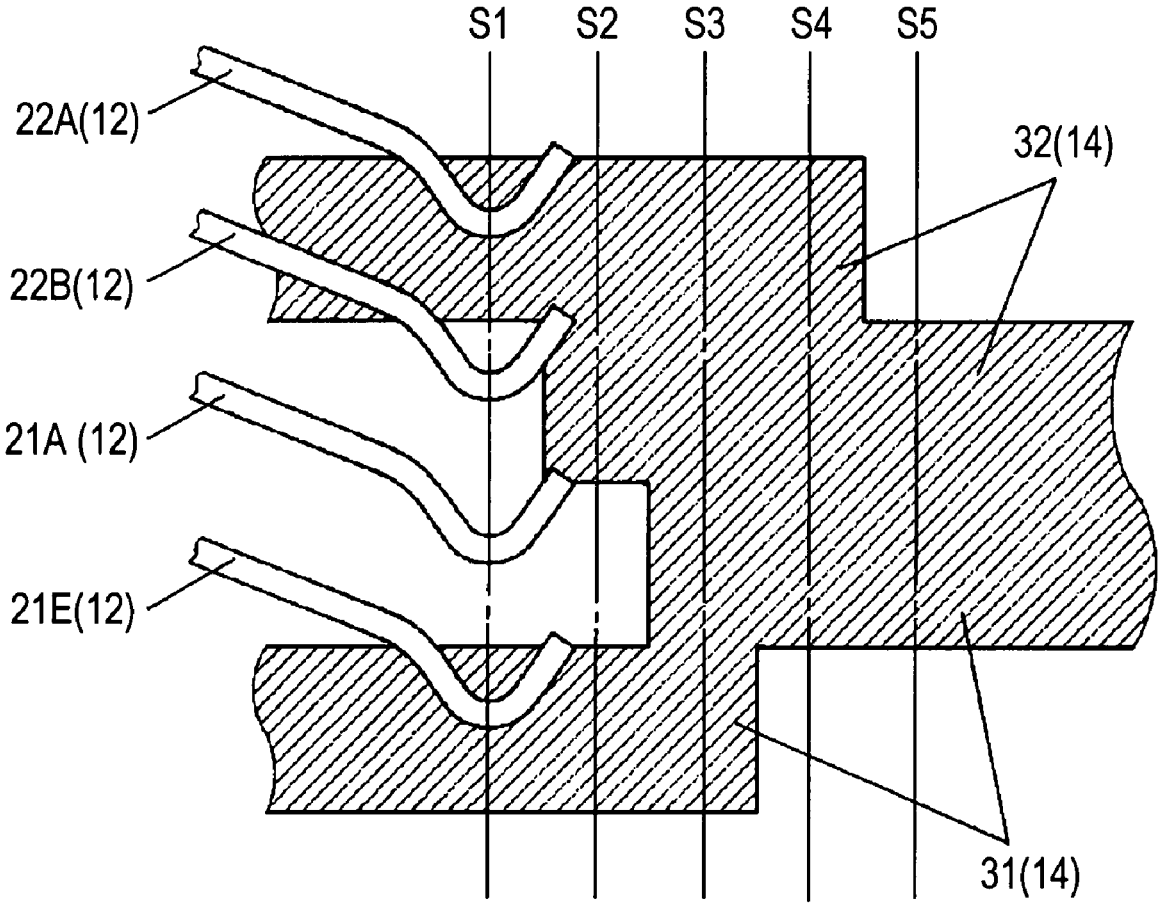
FIG. 7 is a schematic drawing illustrating a state of shifting from FIG. 5 to FIG. 6.

FIG. 5 is a plan view showing contact positions between the contact shoes and the rotary contact plate at the eighth, or the last position in the first large section, FIG. 6 is a plan view showing contact positions between the contact shoes and the rotary contact plate at the ninth, or the first position in the second large section, and FIG. 7 is a schematic drawing illustrating a state of shifting from FIG. 5 to FIG. 6.

In FIG. 5, black dots are added to indicate only points where common contact shoe 22A and signal contact shoe 21E are in contact with rotary contact plate 14 as they relate to the eighth position described here. In FIG. 6, black dots are added to only points where common contact shoe 22B and signal contact shoe 21A are in contact with rotary contact plate 14 as they relate to the ninth position described here.

In the eighth position of FIG. 5, common contact shoe 22A and signal contact shoe 21E are in thrust contact and therefore in the state of continuity with common conductive portion 32 and signal conductive portion 31 respectively, whereas common contact shoe 22B and signal contact shoe 21A are not on the conductive portion of rotary contact plate 14, and they are out of continuity. In the ninth position of FIG. 6, common contact shoe 22B and signal contact shoe 21A are in thrust contact and therefore in the state of continuity with common conductive portion 32 and signal conductive portion 31 respectively, whereas common contact shoe 22A and signal contact shoe 21E are out of positions on the conductive portion of rotary contact plate 14, and therefore not in the state of continuity. When rotary body 13 is turned from the position of FIG. 5 to the position of FIG. 6 in the direction of an arrow shown in FIG. 5, rotary contact plate 14 advances from the position S1 in FIG. 7, which represents the eighth position of FIG. 5, to the next position S2 in FIG. 7. This advancement causes common contact shoe 22B to slide onto common conductive portion 32, thereby making three contact shoes 12 including common contact shoe 22B in addition to common contact shoe 22A and signal contact shoe 21E into the state of continuity.

Rotary contact plate 14 then advances to position S3, and signal contact shoe 21A slides onto signal conductive portion 31, which makes four contact shoes 12, i.e., common contact shoe 22A, common contact shoe 22B, signal contact shoe 21A and signal contact shoe 21E, into thrust contact with rotary contact plate 14, and in the state of continuity.

Rotary contact plate 14 advances next to position S4, where signal contact shoe 21E slides out of signal conductive portion 31 to turn into the state of non-continuity. When Rotary contact plate 14 advances further to position S5, common contact shoe 22A also slides out of conductive portion 32 to turn into the state of non-continuity. In this position S5, common contact shoe 22B and signal contact shoe 21A are in thrust contact and therefore in the state of continuity with common conductive portion 32 and signal conductive portion 31 respectively while common contact shoe 22A and signal contact shoe 21E are out of positions on the conductive portion of rotary contact plate 14, and therefore not in the state of continuity. That is, the rotary type encoder is shifted to the ninth position, or the first position in the second large section, shown in FIG. 6.

According to this exemplary embodiment, as described here, continuity of the common contact side is made with common contact shoe 22B from the previous state, in which only common contact shoe 22A is in contact with common conductive portion 32, so that two common contact shoes 22A and 22B come into contact with common conductive portion 32 in the beginning when shifting from the first large section to the second large section. With the above condition remaining unchanged, common contact shoe 21A, not in contact previously, comes into contact with common conductive portion 32 first, and signal contact shoe 21E, previously in contact, then comes out of signal conductive portion 31 to become not in contact, so as to shift into the state of the ninth position. Finally, common contact shoe 22A comes out of common conductive portion 32, leaving only common contact shoe 22B in contact with common conductive portion 32, and here completes the shifting into the continuity mode of the ninth position.

As described, shifting from one large section to another is carried out in the manner that the continuity of the common contact shoe changes only after the state of continuity of the signal contact side changes to the mode of the next large section while maintaining the continuity of the two adjoining common contact shoes with the common conductive portion. This can prevent any chance of repeating the same continuity mode of the common contact shoes and the signal contact shoes, and it hence evades malfunction of microcomputers in not only certain angular positions but all of the operating positions.

The rotary type encoder of the present invention is useful for application to input control unit of any electronic apparatus since it has the two-track structure of small external size, and adaptable for detecting an operating angle at n positions of equal angular intervals.

What is claimed is:

1. A rotary type encoder having an operable angle smaller than 360°, and adaptable for detecting an operating angle at each of n positions of equal angular intervals within a range of the operable angle, the rotary type encoder comprising a plurality of signal contact shoes and a plurality of common contact shoes disposed in an electrically independent manner along two concentrical tracks, the range of the operable angle divided into m parts of large sections having an equal angle, the plurality of signal contact shoes coming into thrusting contact with signal conductive portions in different states at each of the positions within the large section, and the states of thrusting contact are repeated in each of the large sections, the plurality of common contact shoes being m pieces for the purpose of distinguishing the states of thrusting contact between the signal contact shoes and the signal conductive portions as occurring in each of the large sections, each of the common contact shoes coming into contact at least with a common conductive portion within respective one of the large sections, and the signal conductive portions and the common conductive portion being electrically continuous, wherein the position of the operating angle is determined by detecting continuity between each of the signal contact shoes and each of the common contact shoes.

2. The rotary type encoder of claim 1, wherein:

the plurality of signal contact shoes are $(n/(2\times m)+1)$ pieces disposed individually at angular intervals of one position; and the signal contact shoes slide with thrust contact over the signal conductive portions, each having an angle of $(n/(2\times m)+1)\times$(angle of one position) arranged in an alternate manner with non-conductive portions having an angle of $(n/(2\times m)-1)\times$(angle of one position).

3. The rotary type encoder of claim 1, wherein the contact shoes and the conductive portions are individually so disposed that, at a boundary of shifting from one of the large sections to the adjoining large section, states of continuities change in the order that:

one of the common contact shoes newly assigned to the adjoining large section comes into contact with the common conductive portion;

one of the signal contact shoes newly assigned to the adjoining large section comes into contact with one of the signal conductive portions;

another of the signal contact shoes assigned to the one of the large sections and previously in contact with another of the signal conductive portions comes out of contact therewith; and finally another of the common contact shoes assigned to the one of the large sections and previously in contact with the common conductive portion comes out of contact therewith, to complete the shifting.

* * * * *